United States Patent [19]

Pflug

[11] Patent Number: 4,606,136

[45] Date of Patent: Aug. 19, 1986

[54] SIPHON FOR USE IN PAPER OR CARDBOARD MACHINE DRYERS

[75] Inventor: Dieter Pflug, Bad Vilbel, Fed. Rep. of Germany

[73] Assignee: V.I.B.-Apparatebau GmbH, Maintal, Fed. Rep. of Germany

[21] Appl. No.: 724,159

[22] Filed: Jun. 17, 1985

[30] Foreign Application Priority Data

Apr. 18, 1984 [DE] Fed. Rep. of Germany ..... 3414605

[51] Int. Cl.[4] ..... F26B 13/08

[52] U.S. Cl. ..... 34/125; 34/119

[58] Field of Search ..... 34/119, 124, 125; 165/86, 87, 88, 89

[56] References Cited

U.S. PATENT DOCUMENTS 3,368,288 2/1968 Bell ..... 34/125

4,384,412 5/1983 Chance et al. ..... 34/125

FOREIGN PATENT DOCUMENTS 2413271 10/1974 Fed. Rep. of Germany .

3237994 4/1984 Fed. Rep. of Germany .

*Primary Examiner*—Larry I. Schwartz

*Attorney, Agent, or Firm*—Peter K. Kontler

[57] ABSTRACT

A rotary siphon in the steam-filled internal chamber of the rotating cylindrical shell in a paper or cardboard machine dryer has a hollow conical housing which defines with the internal surface of the shell an annular suction gap and spacedly surrounds a conical insert whose base abuts against the internal surface of the shell. The housing and the insert define an annular channel whose radially outermost portion communicates with the gap and whose radially innermost portion communicates with the interior of a condensate evacuating conduit. The condensate accumulates along the internal surface of the shell and is compelled to flow radially inwardly by way of the gap and channel and into the conduit due to the establishment of a pressure differential between the channel and the internal chamber of the shell. Such pressure differential is established by compressed steam which flows from the internal chamber, through the axially extending bores of screws which center the insert in the housing of the siphon, and through an orifice which is provided in the conical tip of the insert and communicates with the channel close to the locus of communication between the channel and the interior of the conduit. The inner surface of the housing and the outer surface of the insert are curved in such a way that they make a progressively smaller angle with the common axis of the insert and the housing, as considered in a direction from the internal surface toward the axis of rotation of the shell.

22 Claims, 3 Drawing Figures

SIPHON FOR USE IN PAPER OR CARDBOARD MACHINE DRYERS

BACKGROUND OF THE INVENTION

The present invention relates to improvements in steam heated dryers, particularly to improvements in paper or cardboard machine dryers. More particularly, the invention relates to improvements in rotary siphons which are used in such dryers to evacuate condensate which accumulates therein as a result of exchange of heat between a rotary cylindrical shell and steam which is admitted into the interior of the rotating shell, normally through a conduit whose axis coincides with the axis of rotation of the shell.

The condensate gathering and evacuating siphons which are used in the shells of paper or cardboard machine dryers comprise one or more hollow housings which are adjacent to but slightly spaced apart from the internal surface of the rotating shell so as to define with the internal surface a relatively narrow gap through which condensate can penetrate from the interior of the shell into the interior of the housing. The condensate which accumulates in the interior of the housing is evacuated by way of a conduit which extends axially and from the interior of the rotating shell. It is further known to introduce pressurized steam into the interior of the housing at a location which is spaced apart radially inwardly from the internal surface of the shell so that the admitted steam flows into the aforementioned condensate evacuating conduit and causes the housing to suck condensate from the internal chamber of the shell, through the gap and into the intake end of the conduit.

In accordance with a prior proposal, the housing of the siphon has a regular conical surface which is adjacent to the gap between the housing and the internal surface of the shell, and a concavely curved section which is located radially inwardly of the regular conical surface and merges gradually into the conduit for evacuation of collected condensate. A port is provided in the housing radially inwardly of the junction between the concavely curved portion and the conduit to admit steam which flows from the inrternal chamber of the shell and propels condensate from the gap toward and into the conduit. The direction of inflow of steam is substantially at right angles to the axis of the housing. In normal operation, the ratio fo condensate to admitted steam in the interior of the housing is betwen 75 to 85 and 25 to 15 percent. The admixture of steam to condensate in the housing of the siphon results in the establishment of a pressure differential between the steam in the interior of the shell and condensate in the interior of the evacuating conduit so that the condensate in the housing flows radially inwardly against the opposition of centrifugal force and toward the axis of rotation of the shell to be evacuated by way of that portion of the conduit whose axis coincides with the axis of the shell. If the shell contains a rather substantial quantity of condensate, the gap between the radially outermost portion of the housing and the internal surface of the shell is flooded so that steam which is admitted into the internal chamber of the shell cannot penetrate into and mix with the condensate in the housing. Consequently, the condensate cannot flow against the action of centrifugal force because the pressure differential between the internal chamber of the shell and the interior of the housing is too small. At such time, the port in the wall of the housing acts as an injector and is supposed to entrain droplets of condensate in a direction toward and into the interior of the evacuating conduit. When the flooding of the gap is terminated, the inflowing steam is again free to mix with the condensate which enters the housing by way of the gap so that the pressure differential between the interior and the exterior of the housing increases and the mixture of steam and condensate can flow radially inwardly from the internal surface of the shell toward the axis of rotation to be withdrawn by way of the aforementioned axially extending portion of the evacuating conduit.

The prior art of which applicant is aware at this time includes German Offenlegungsschrift No. 2 413 271, German Offenlegungsschrift No. 32 37 994, and U.S. Pat. No. 4,384,412.

OBJECTS AND SUMMARY OF THE INVENTION

An object of the invention is to provide a dryer, which serves to dry webs of fibrous material in paper making and analogous machines, with a novel and improved siphon which can properly and reliably evacuate condensate from the interior of a rotating shell even if the pressure differential between the interior and the exterior of the housing of the siphon is much less than the minimum pressure differential required for adequate operation of heretofore known siphons.

Another object of the invention is to provide a siphon which can be utilized in existing steam heated dryers for paper or cardboard machines as a superior substitute for conventional siphons.

A further object of the invention is to provide a siphon which is constructed and assembled in such a way that it reliably ensures predictable and continuous flow of condensate from the gap toward the conduit which serves for evacuation of condensate from the interior of the rotating shell of the dryer.

An additional object of the invention is to provide a novel and improved method of evacuating condensate from the interior of a rotating shell in a paper or cardboard machine dryer.

Still another object of the invention is to provide novel and improved means for mounting the above outlined siphon in the interior of a rotating shell.

Another object of the invention is to provide novel and improved means for admitting steam into the interior of the above outlined siphon.

A further object of the invention is to provide a relatively simple and inexpensive siphon which embodies the above outlined features and advantages and which can be used singly or in combination with one or more additional siphons of identical or similar design.

One feature of the invention resides in the provision of a combination of parts which are utilized in a dryer, particularly in a paper machine or cardboard machine dryer. Such parts comprise a rotary cylindrical shell having an internal surface (which is preferably a cylindrical surface) and defining an internal chamber which is surrounded by the internal surface, means (such as a hub rotatably mounting the shell) for admitting into the internal chamber steam at a temperature sufficiently high to heat the shell whereby a layer or pool of condensate accumulates along the internal surface of the thus heated shell, and means for evacuating condensate from the chamber. The evacuating means includes at least one rotary siphon which has a housing adjacent to but spaced apart from and defining a suction gap with the internal surface of the shell, and an insert which is installed in and is spaced apart from the housing and defines therewith an annular channel whose diameter decreases in a direction radially inwardly of and away from the internal surface of the shell and which communicates with the gap. A steam passage, which is defined by the insert and the housing, includes an intake portion communicating with and receiving steam from the chamber and an outlet orifice which is disposed radially inwardly of the intake portion of the passage and communicates with the channel so that steam flowing from the intake portion into and from the orifice draws condensate from the internal surface by way of the gap and into the channel. The siphon further includes conduit means extending from the chamber and having an inlet communicating with the channel radially inwardly from the insert. The conduit means receives condensate which is caused to flow into the conduit means by steam that is admitted into the passage and issues by way of the orifice. The intake portion of the passage is preferably located radially inwardly of the gap. Also, at least that portion of the conduit means which is connected to the housing is coaxial with the orifice of the passage.

The insert preferably comprises a pointed end portion which is remote from the gap, and the orifice is preferably provided in such pointed end portion of the insert. The pointed end portion preferably constitutes a cone whose vertex angle is less than 46°.

At least one of the parts including the housing and the insert has a circular cross-sectional outline. It is preferred to provide the insert with a substantially conical outer surface which is surrounded by the channel, and to provide the housing with a substantially conical inner surface which surrounds the channel. The conicity of at least one of the inner and outer surfaces preferably varies in a direction from the internal surface of the shell toward the axis of rotation of the shell. The axis of the housing preferably extends radially of the internal surface of the shell and the inclination of the one substantially conical surface with reference to the axis of the housing preferably decreases gradually in a direction away from the internal surface of the shell.

The passage preferably includes a blind hole or bore which is provided in the insert and the siphon preferably further comprises at least one fastener which connects the insert with the housing and defines the intake portion of the passage. Such intake portion connects the blind hole with the internal chamber of the shell. The fastener preferably includes an externally threaded shank which mates with the insert and has an axial bore constituting the aforementioned intake portion of the passage.

Another feature of the invention resides in the provision of a dryer, particularly a paper or cardboard machine dryer, which comprises a rotary cylindrical shell having an internal surface and defining an internal chamber which is surrounded by the internal surface, means for admitting into the chamber steam to heat the shell whereby a layer of condensate accumulates along the internal surface of the shell, and novel and improved means for evacuating condensate from the chamber. Such evacuating means includes at least one rotary siphon having a housing which is adjacent to but slightly spaced apart from and defines a suction gap with the internal surface of the shell, an insert which is installed in the housing and defines therewith an annular channel having an intake end which communicates with and merges gradually into the gap and a discharge end which is spaced apart from and is located radially inwardly of the internal surface, and conduit means which is connected with the housing radially inwardly of the insert and defines a passage. The diameter of the channel decreases gradually in a direction from the gap toward the passage of the conduit means, and the discharge end of the channel merges gradually into the passage. The housing of the siphon has an axis which extends substantially radially of the internal surface of the shell, and the housing and the insert respectively have inner and outer surfaces which respectively surround and are surrounded by the channel. The inclination of at least one of the inner and outer surfaces relative to the axis of the housing varies in a direction radially inwardly from the internal surface of the shell.

The insert preferably comprises or constitutes a cone having a vertex in the region of the discharge end of the channel. The cross-sectional area of the gap at least approximates the cross-sectional area of the passage in the region of the discharge end of the channel, and the cross-sectional area of the channel in each of a plurality of planes extending at right angles to the axis of the housing also equals or approximates the cross-sectional area of the gap.

The siphon can further comprise a tubular carrier which surrounds and supports the conduit means.

At least one of the inner and outer surfaces is or can constitute a paraboloid surface. The inner surface of the housing can be provided with a convex ring-shaped portion which is adjacent to and is disposed inwardly of the gap, as considered radially of the internal surface. At least one of the inner and outer surfaces is preferably a hydraulically smooth surface.

The conduit means preferably includes a first portion which extends radially of the shell and a second portion which receives condensate from the first portion and whose axis coincides with the axis of rotation of the shell.

Still further, the siphon can comprise means for biasing the insert against the internal surface of the shell. The latter is preferably rotatable about a horizontal or substantially horizontal axis.

The novel features which are considered as characteristic of the invention are set forth in particular in the appended claims. The improved dryer itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
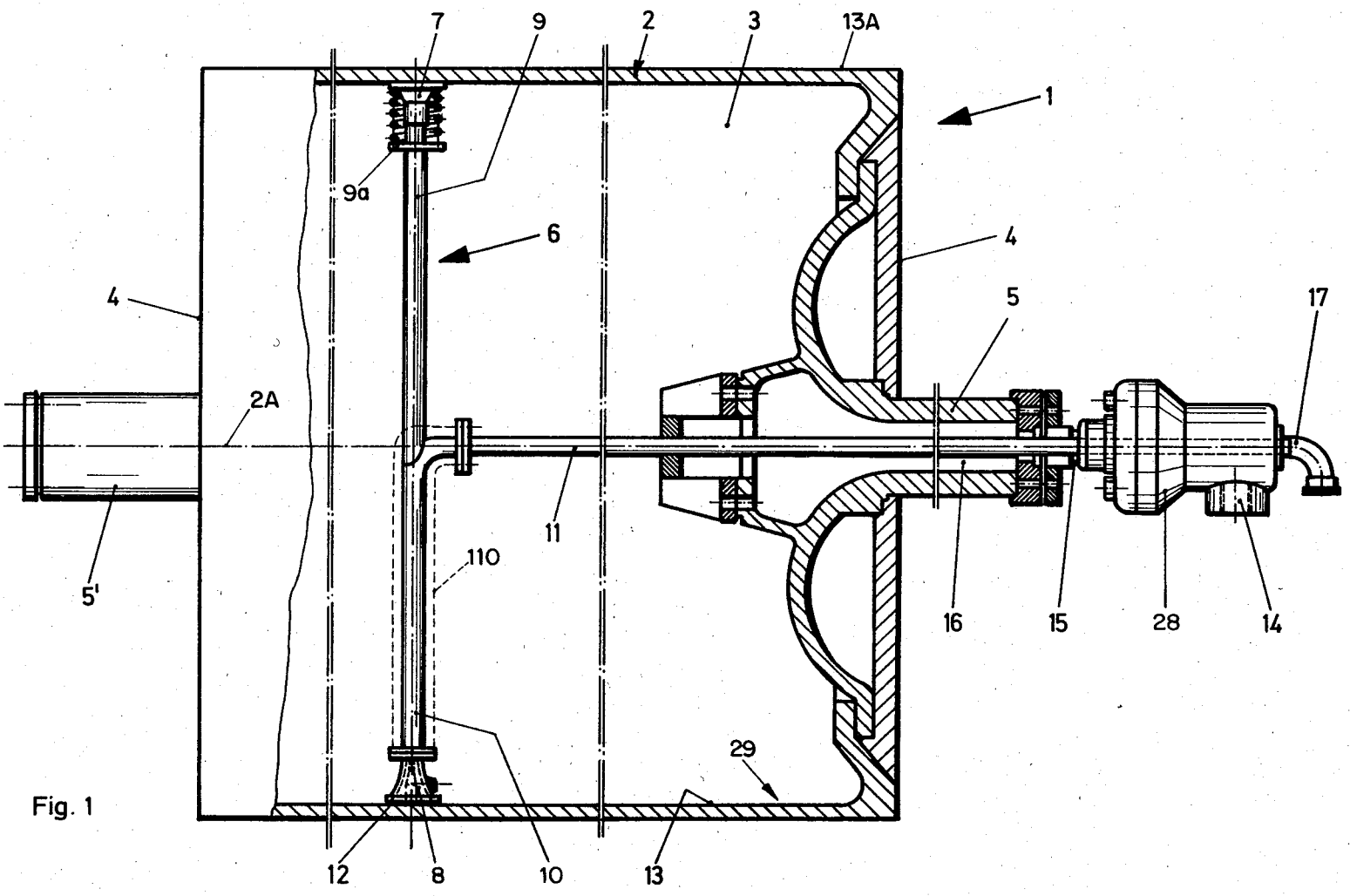
FIG. 1 is a fragmentary partly elevational and partly sectional view of a dryer having a siphon which embodies one form of the invention.

FIG. 1 shows a portion of a dryer which can be used in a paper or cardboard machine and includes a hollow cylindrical rotary steam dryer drum assembly 1 having a hollow annular shell 2 which is rotatable about a horizontal axis 2A. The ends of the internal chamber 3 of the shell 2 are sealed by heads or end walls 4 which support the shell 2 and are rotatable relative to two hubs 5 and 5'. The shell 2 is rotated relative to the hubs 5 and 5' by the web of fibrous material (not shown) which contacts and is dried by the external surface 13A of the shell.

Figure 2:
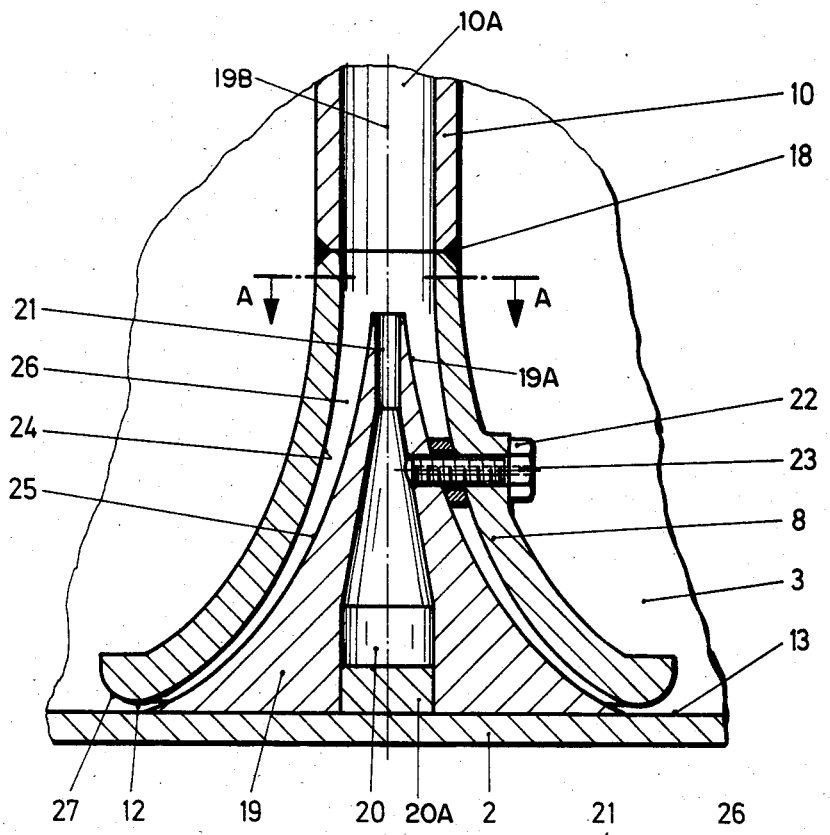
FIG. 2 is an enlarged axial sectional view of the siphon and of the adjacent portion of the shell of the dryer.
Figure 3:
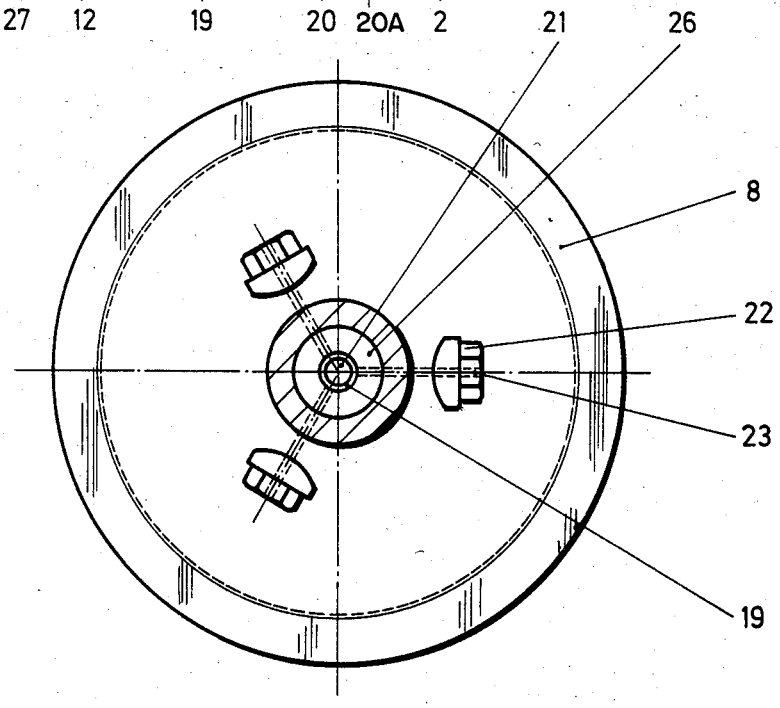
FIG. 3 is a sectional view as seen in the direction of arrows from the line A—A of FIG. 2.

The internal chamber 3 of the shell 2 accommodates a siphon or siphon tip 6 the details of which are illustrated in FIGS. 2 and 3. A coil spring 7 is provided to bias the siphon 6 radially outwardly toward the cylindrical internal surface 13 of the shell 2. The coil spring 7 reacts against the shell 2 and bears against a collar 9*a* of a radially extending prop or brace 9 for a radially extending conduit 10 serving as a means for evacuating condensate which is accumulated by the siphon 6. The conduit 10 includes a horizontal portion 11 which is coaxial with the shell 2 and serves to evacuate the accumulated condensate from the internal chamber 3 by way of the stationary hub 5. The reference character 12 denotes a relatively narrow suction gap which is defined by the internal surface 13 of the shell and the substantially bell-shaped housing 8 of the siphon 6. The gap 12 serves to admit condensate 29 which forms a layer along the internal surface 13 of the shell 2 when the latter is being heated by steam which is admitted by way of the stationary hub 5 to fill the chamber 3 and to exchange heat with the shell 2. The hub 5 is adjacent to a steam admitting head 28 having an inlet 14 for hot steam. Such steam flows from the inlet 14 toward and through an annular space 15 of the head 28 and thence into the internal space 16 of the hub 5. The space 16 communicates with the internal chamber 3 of the shell 2. The condensate 29 normally forms a relatively thin layer which coats the internal surface 13 of the shell 2.

The steam admitting head 28 is further formed with an outlet 17 which discharges condensate and communicates with the discharge end of the axially extending portion 11 of the steam evacuating conduit 10 of the siphon 6. The condensate is caused to enter the gap 12 and to flow through the housing 8 into the conduit 10 and outlet 17 as a result of the establishment of a pressure differential between the interior of the shell 2 and the interior of the housing 8.

The details of the siphon 6 are shown in FIGS. 2 and 3. The bell-shaped housing 8 flares outwardly toward the internal surface 13 of the rotating shell 2 and its radially innermost portion (namely the portion which is nearest to the axis 2A of the shell 2) is welded or otherwise sealingly connected (at 18) to the adjacent intake end of the radially extending condensate evacuating conduit 10. The siphon 6 further comprises a substantially conical insert 19 which abuts against the adjacent portion of the internal surface 13 of the shell 2 under the action of the coil spring 7 and defines with the internal surface 24 of the housing 8 an annular clearance or channel 26 which has an intake end communicating with the suction gap 12 and a discharge end communicating with the cylindrical passage 10A in the adjacent radially outermost portion of the conduit 10. The insert 19 has a conical pointed end portion or tip 19*a* which is adjacent to the connection 18 and is formed with a relatively narrow cylindrical orifice 21 for admission of steam into the stream of condensate flowing from the gap 12, between the surfaces 24, 25 of the housing 8 and insert 19, and into the passage 10A of the conduit 10. The passage including the orifice 21 further includes a blind hole or bore 20 in the interior of the insert 19 radially outwardly of the orifice 21 and a portion which is defined by the axial bores 23 of externally threaded shanks of screws, bolts, or analogous fasteners 22 serving to center the insert 19 in the interior of the housing 8 in a position which is best shown in FIG. 2. In such position, the common axis 19B of the insert 19, its blind hole 20 and its orifice 21 coincides with the axis of the radially outermost portion of the condensate evacuating conduit 10. In the illustrated embodiment of the siphon 6, the insert 19 is centered by three equidistant fasteners 22 which mesh with the insert 19 in such a way that their axial bores 23 communicate with the blind hole 20 radially outwardly of the orifice 21 but radially inwardly of the suction gap 12. That side of the gap 12 which faces away from the internal surface 13 of the shell 2 is bounded by a convex ring-shaped portion 27 of the inner surface 24 of the housing 8. Such surface spacedly surrounds the channel 26 which latter surrounds the substantially conical outer surface 25 of the insert 19. At least one of the surfaces 24,25 is preferably a hydraulically smooth surface.

When the shell 2 rotates about the axis 2A and its chamber 3 receives hot steam from the internal space 16 of the hub 5, some of the steam in the chamber 3 enters the blind hole 20 of the insert 19 by way of the axial bores 23 in the fasteners 22 and issues by way of the orifice 21 so as to draw condensate 29 from the layer at the internal surface 13 of the shell, through the suction gap 12, through the channel 26 and into the passage 10A which is defined by the conduit 10. The thus conveyed condensate enters the axially extending portion 11 of the conduit 10 and is evacuated from the assembly 1 by way of the outlet 17. Since the fasteners 22 fixedly connect the insert 19 to the housing 8, they determine the width of the suction gap 12, as considered in the radial direction of the shell 2. The surfaces 24 and 25 have circular outlines, as considered in planes which are normal to the common axis 19B of the housing 8 and insert 19. At least one of the surfaces 24, 25 is preferably a portion of a paraboloid. It is presently preferred to design the outer surface 25 in such a way that it constitutes a paraboloid that is formed by a higher (second) degree curve. The inner surface 24 of the housing 8 is preferably a paraboloid formed by a fourth degree curve. This paraboloid extends beyond the narrowest portion of the suction gap 12 to constitute the aforementioned convex surface portion 27. Such configuration of the surfaces 24 and 25 ensures gradual and continuous inflow of condensate 29 from the layer at the internal surface 13 of the shell 2, through the gap 12, and through the major part of the channel 26 into the passage 10A which is defined by the conduit 10. The flow of condensate is substantially at right angles to the axis 2A of rotation of the shell 2. Deflection of condensate 29 from the internal surface 13 of the shell 2 into the passage 10A of the conduit 10 is gradual all the way from the suction gap 12 to the connection 18 between the housing 8 and the conduit 10. The arrangement is such that, when an increment of the condensate stream flowing from the channel 26 toward the passage 10A in the conduit 10 travels along the pointed end portion 19*a* of the insert 19, such stream has only a very small component of flow in the radial direction of the conduit 10. This ensures that the injector action of pressurized steam issuing from the aforementioned passage 23, 20, 21 by way of the orifice 21 is highly satisfactory, especially in view of the aforediscussed design of the surfaces 24 and 25 bounding the channel 26. The rate of flow of condensate toward the passage 10A in the conduit 10 is uniform, as considered in the circumferential direction of the pointed end portion 19*a* of the insert 19.

FIG. 2 shows that the width of the channel 26 between the surfaces 24 and 25 of the housing 8 and insert 19, as measured radially of the common axis 19B of the insert 19 and housing 8, increases gradually from the suction gap 12 toward the passage 10A in the conduit 10. In other words, the cross-sectional area of the insert 19 varies continuously and gradually all the way from the internal surface 13 of the shell 2 toward the radially innermost portion of the tip 19*a*. It is preferred to dimension the channel 26 in such a way that its cross-sectional area (as measured in planes making an angle of 90° with the axis 19B) is constant or at least substantially constant all the way from the suction gap 12 to the passage 10A in the conduit 10, and also that the cross-sectional area of the passage 10A in the conduit 10 equals or approximates the cross-sectional area of the suction gap 12. It is further possible to design the surfaces 24 and 25 in such a way that the cross-sectional area of the channel 26 at the discharge end of the orifice 21 is slightly less than the cross-sectional area of the passage 10A in the conduit 10 so as to ensure that the combined volume of condensate flowing toward the conduit 10 and of steam issuing from the orifice 21 will suffice to fill the radially innermost portion of the housing 8 in the region where the housing 8 is connected (at 18) with the conduit 10. Since the speed of the condensate flowing from the suction gap 12 toward the interior of the conduit 10 does not vary appreciably, the losses in pressure are negligible or minimal.

It has been found that the aforediscussed shape of the channel 26 and the utilization of a radially extending orifice 21 ensures a highly satisfactory evacuation of condensate from the internal surface 13 of the shell 2 into the outlet 17 of the steam admitting head 28. The pressure differential which must be established between the inlet 14 and outlet 17 of the head 28 is relatively small, especially when compared with the pressure differential which is required in conventional siphons. Moreover, the improved siphon can operate with relatively small quantities of steam which is admitted via the passage including the bores 23, the hole 20 and the orifice 21 to mix with and to entrain condensate 29 flowing from the suction gap 12 into the passage 10A of the conduit 10.

The dimensions of the component parts of the siphon 6 depend on a plurality of parameters. Thus, the cross-sectional area of the suction gap 12, channel 26 and passage 10A in the conduit 10 will depend on the dimensions of the shell 2, the required drying action of the assembly 1 and many other factors. If the passage 10A which is defined by the conduit 10 does not suffice for adequate evacuation of condensate that accumulates along the internal surface 13 of the shell 2, it is possible to surround the conduit 10 with a stable tubular carrier 110 which is connected with the external surface of the housing 8.

It is also within the purview of the invention to evacuate condensate 29 from the shell 2 by utilizing two or more identical or similar siphons 6.

The orifice 21 of the steam-admitting passage further including the intake bores 23 and blind hole or bore 20 can be said to constitute an injector which is designed to inject steam in the direction of the common axis 19B of the housing 8 and insert 19 and toward the inlet of the passage 10A in the conduit 10. Since the channel 26 is an annulus of progressively decreasing diameter (as considered in a direction from the gap 12 toward the connection 18 between the housing 8 and the conduit 10), condensate 29 which enters the channel 26 via gap 12 and flows toward the passage 10A of the conduit 10 is entrained by the jet of steam issuing from the orifice 21 substantially without any deflection and is compelled to flow toward the portion 11 of the conduit 10 and into the outlet 17 of the head 28. The two undertakings (namely, the formation of a jet of steam which flows axially into the conduit 10 and of a channel 26 whose diameter decreases gradually in a direction from the gap 12 toward the conduit 10) ensure the establishment of a pronounced propulsive effect upon the condensate 29 irrespective of whether or not the condensate which has accumulated along the internal surface 13 of the shell 2 floods the suction gap 12. This, in turn, renders it possible to ensure reliable and predictable evacuation of condensate even if the pressure differential between the channel 26 and the chamber 3 is much less pronounced than in heretofore known dryers employing conventional siphons. Operation with a relatively small pressure differential is desirable and advantageous because the energy requirements of the siphon are low.

The substantially conical insert 19 further prevents the development of low-pressure areas adjacent to the internal surface 13 and cavitation which could entail rapid destruction of the shell. Moreover, the improved insert 19 reduces the likelihood of the development of eddy currents and other turbulences which could entail pronounced pressure losses. All in all, the improved siphon 6 not only ensures more predictable evacuation of substantial quantities of condensate 29 but it also achieves such pronounced evacuation of condensate with surprisingly small quantities of steam which flows from the chamber 3, through the axial bores 23, through the blind hole 20 and into and out of the orifice 21. The insert 19 is relatively simple and inexpensive since it is only necessary to provide its body with an axial blind bore one part of which constitutes the orifice 21 and the other part of which constitutes the blind hole 20. The lower end of the hole 20, as viewed in FIG. 2, can be sealed by a plug 20A of a suitable metallic or other material. The insert 19 is further provided with tapped bores for the shanks of the fasteners 22. The provision of an orifice in the conical end portion 19A of the insert 19 brings about the aforediscussed advantage that the condensate 29 flowing from the gap 12 toward the passage 10A of the conduit 10 completely surrounds the jet of steam which issues from the orifice 21 and that such jet can entrain the condensate in the direction of the axis 19B without any or with minimal changes in the direction of flow of condensate around and beyond the end portion 19A. Each of the parts including the housing 8 and the insert 19 is preferably a body consisting of two mirror symmetrical halves with reference to any one of an infinite number of planes including the axis 19B. This also contributes to more predictable flow of condensate 29 from the suction gap 12 toward the inlet of the passage 10A in the conduit 10. Uniform distribution of the stream of condensate 29 flowing from the gap 12 toward the conduit 10 is desirable because this enhances the effectiveness of the jet of steam issuing from the orifice 21. The vertex angle of the conical end portion 19A of the insert 19 is preferably less than 46 degrees. This ensures that the stream of condensate 29 flowing from the gap 12 toward the conduit 10 has a major component of movement in the direction of the axis 19B.

The aforediscussed configuration of the surfaces 24 and 25 (so that the angle which these surfaces make with the axis 19B decreases gradually in a direction from the base of the insert 19 toward the axis 2A of the shell 2) ensures gradual changes in the direction of condensate flow from the internal surface 13 toward and into the passage 10A of the conduit 10. Therefore, pressure losses are minimal and the injector orifice 21 can effectively reduce the likelihood of, or it completely eliminates, the development of turbulences in the stream of condensate between the gap 12 and the interior of the conduit 10.

The feature that the fasteners 22 perform several functions (including centering the insert 19 in the interior of the housing 8 of the siphon 6 and defining the intake portion of the steam-admitting passage 23, 20, 21) contributes to compactness, simplicity and lower cost of the siphon.

The improved siphon constitutes a superior substitute for heretofore known siphons, including those which are disclosed in the aforeenumerated prior publications, with or without the steam-admitting passage 23, 20, 21. The feature that the surfaces 24, 25 define a channel 26 whose configuration is such that the stream of condensate 29 which enters by way of the gap 12 is compelled to gradually change the direction of its flow from a first direction substantially radially inwardly toward the axis 19B to a second direction (axially of the conduit 10) ensures that pressure losses due to changes in the direction of flow of condensate are reduced to a minimum. It has been found that a siphon which does not have the steam-admitting passage (23, 20, 21) but exhibits the other features of the siphon which is shown in FIGS. 2 and 3 is capable of operating with a pressure differential between the chamber 3 and the channel 26 which is much less pronounced than that which is required in conventional siphons. Nevertheless, the utilization of an insert which is formed with an injector orifice receiving steam from the internal chamber 3 of the shell 2 is preferred in many instances because the jet of steam issuing from the orifice 21 contributes significantly to an even more satisfactory evacuation of condensate from the interior of the shell.

It was further ascertained that the evacuation of condensate from the interior of the shell 2 is especially satisfactory if the cross-sectional area of the suction gap 12 equals or approximates not only the cross-sectional area of the passage 10A in the conduit 10 but also the cross-sectional area of the channel 26 in any of a large or infinite number of planes making an angle of 90 degrees with the common axis 19B of the housing 8 and insert 19. If one disregards that acceleration of condensate which is caused by the jet of steam issuing from the orifice 21, the velocity of the stream of condensate should match or should not appreciably deviate (preferably by not more than $\pm 12\%$) from an average value. If the speed of the condensate does not vary (or varies only negligibly) during flow from the internal surface 13 of the shell 2 into the passage 10A of the conduit 10, the losses in pressure are reduced to a minimum. The tubular carrier 110 (shown in FIG. 1 by broken lines) is used if the conduit 10, 11 is too weak to reliably support the housing 8 and the insert 19 of the improved siphon.

An advantage of a siphon wherein the channel 26 is bounded by rotational paraboloid surfaces (24 and 25) is that the tangent at the zero point of a parabola is normal to the axis of the parabola. The angle between the tangent and the common axis 19B of the housing 8 and insert 19 decreases gradually in a direction from the internal surface 13 toward the axis 2A of the shell 2. As mentioned above, the inner surface 24 of the housing 8 can constitute a fourth-degree paraboloid and the outer surface 25 of the insert 19 can constitute a paraboloid of the second degree.

The convex portion 27 of the internal surface 24 in the region of the suction gap 12 reduces the likelihood of pressure losses at the locus where the condensate 29 flows from the internal surface 13 of the shell 2 into the channel 26. The convex portion 27 can constitute an extension of the fourth-degree paraboloid.

The feature that the surface 24 and/or 25 constitutes a hydraulically smooth surface is desirable and advantageous because this reduces the likelihood of the development of boundary layers.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. In a dryer, particularly in a paper machine dryer, the combination of a rotary cylindrical shell having an internal surface and defining an internal chamber which is surrounded by said surface; means for admitting into said chamber steam to heat said shell whereby a layer of condensate accumulates along said internal surface; and means for evacuating condensate from said chamber, including at least one rotary siphon having a housing adjacent to but spaced apart from and defining a suction gap with said internal surface, and an insert installed in and spaced apart from said housing and defining therewith an annular channel which communicates with said gap, said channel having a diameter which decreases substantially radially inwardly of and away from said internal surface, and said evacuating means additionally comprising a steam passage which extends through said housing and said insert and includes an intake portion communicating with and receiving steam from said chamber; said passage further including an outlet orifice disposed radially inwardly of said intake portion and communicating with said channel so that steam flowing from said intake portion into and from said orifice draws condensate from said internal surface via said gap and into said channel, and said evacuating means also comprising condensate evacuating conduit means extending from said chamber and having an inlet communicating with said channel radially inwardly from said insert.

2. The combination of claim 1, wherein the intake portion of said passage is located radially inwardly of said gap.

3. The combination of claim 1, wherein said conduit means includes a portion which is coaxial with said orifice.

4. The combination of claim 1, wherein said insert has a pointed end portion which is remote from said gap and said orifice is provided in said pointed end portion.

5. The combination of claim 4, wherein said pointed end portion is a cone whose vertex angle is less than 46 degrees.

6. The combination of claim 1, wherein at least one of the parts of said siphon including said housing and said insert has a circular cross-sectional outline.

7. The combination of claim 1, wherein said insert has a substantially conical outer surface which is surrounded by said channel and said housing has a substantially conical inner surface surrounding said channel, the conicity of at least one of said substantially conical surfaces varying in a direction from the internal surface toward the axis of rotation of said shell.

8. The combination of claim 7, wherein said housing has an axis extending radially of said internal surface and the inclination of said one substantially conical surface with reference to the axis of said housing decreases gradually in a direction away from said internal surface.

9. The combination of claim 1, wherein said passage includes a blind hole provided in said insert; and further comprising at least one fastener connecting said insert with said housing and defining said intake portion of said passage, said intake portion connecting said blind hole with the internal chamber of said shell.

10. The combination of claim 9, wherein said fastener has a threaded shank mating with said insert and having an axial bore constituting said intake portion of said passage.

11. In a dryer, particularly in a paper machine dryer, the combination of a rotary cylindrical shell having an internal surface and defining an internal chamber which is surrounded by said surface; means for admitting into said chamber steam to heat said shell whereby a layer of condensate accumulates along the internal surface of said shell; and means for evacuating condensate from said chamber, including at least one rotary siphon having a housing adjacent to but slightly spaced apart from and defining a suction gap with the internal surface of said shell, an insert installed in said housing and defining therewith an annular channel having an intake end which communicates with and merges gradually into said gap and a discharge end spaced apart from and located radially inwardly of said internal surface, and conduit means connected with said housing radially inwardly of said insert and defining a passage, the diameter of said channel decreasing gradually in a direction from said gap toward said passage, and the discharge end of said channel communicating with said passage, said housing having an axis which extends substantially radially of said internal surface, and said housing and said insert respectively having inner and outer surfaces which respectively surround and are surrounded bysaid channel, the inclination of each of said inner and outer surfaces relative to the axis of said housing varying gradually over the span from the region of said intake end to the region of said discharge end so that condensate entering said channel in a first direction gradually turns towards a second direction for discharge from said channel and into said passage.

12. The combination of claim 11, wherein said insert comprises or constitutes a cone having a vertex in the region of the discharge end of said channel.

13. The combination of claim 11, wherein the cross-sectional area of said gap at least approximates the cross-sectional area of said passage in the region of the discharge end of said channel and the cross-sectional area of said channel in each of a plurality of planes extending at right angles to the axis of said housing also equals or approximates the cross-sectional area of said gap.

14. The combination of claim 11, further comprising a tubular carrier surrounding said conduit means.

15. The combination of claim 11, wherein at least one of said inner and outer surfaces is a paraboloid surface.

16. The combination of claim 11, wherein the inner surface of said housing has a convex ring-shaped portion adjacent to and disposed inwardly of said gap, as considered radially of said internal surface.

17. The combination of claim 11, wherein at least one of said inner and outer surfaces is a hydraulically smooth surface.

18. The combination of claim 11, wherein said conduit means includes a first portion which extends radially of the shell and a second portion which receives condensate from said first portion and whose axis coincides with the axis of rotation of said shell.

19. The combination of claim 11, further comprising means for biasing said insert against the internal surface of said shell.

20. The combination of claim 11, wherein said shell is rotatable about a horizontal axis.

21. The combination of claim 11, wherein said first direction at least approximates the axial direction of said shell and said second direction at least approximates the radial direction of said shell.

22. The combination of claim 11, wherein said discharge end is disposed in the region of said passage.

* * * * *

UNITED STATES PATENT AND TRADEMARK OFFICE

CERTIFICATE OF CORRECTION

PATENT NO. : 4,606,136

DATED : August 19, 1986

INVENTOR(S) : Dieter PFLUG

It is certified that error appears in the above-identified patent and that said Letters Patent are hereby corrected as shown below:

Foremost page, [22] Filed: "June 17, 1985" should read --April 17, 1985--.
Col. 1, line 44, "inrternal" should read --internal--.
Col. 1, line 48, "fo" should read --of--.

Signed and Sealed this

Sixteenth Day of December, 1986

*Attest:*

DONALD J. QUIGG

*Attesting Officer* *Commissioner of Patents and Trademarks*